United States Patent [19]

Schaeffer et al.

[11] 4,058,996

[45] Nov. 22, 1977

[54] MACHINE FOR THE MANUFACTURE OF HELICALLY WOUND METAL DUCT OR PIPE

[76] Inventors: Claude W. Schaeffer, 461 Holly Lane, Plantation, Fla. 33317; Martin T. Baker, 1507 SE. 14th St., Fort Lauderdale, Fla. 33316

[21] Appl. No.: 687,309

[22] Filed: May 17, 1976

[51] Int. Cl.[2] ..... B21C 37/12

[52] U.S. Cl. ..... 72/49; 72/180

[58] Field of Search ..... 72/49, 50

[56] References Cited

U.S. PATENT DOCUMENTS

| | | | |
|---|---|---|---|
| 3,263,321 | 8/1966 | Lombardi | 72/49 X |
| 3,538,728 | 11/1970 | Trilney | 72/49 |
| 3,566,643 | 3/1971 | Westerbarkey | 72/49 |
| 3,858,421 | 1/1975 | Wood | 72/50 |
| 3,982,414 | 9/1976 | Anderson | 72/50 |

FOREIGN PATENT DOCUMENTS

| | | | |
|---|---|---|---|
| 2,520,544 | 11/1975 | Germany | 72/50 |

*Primary Examiner*—Milton S. Mehr
*Attorney, Agent, or Firm*—Malin & Haley

[57] ABSTRACT

A machine for manufacturing metal duct or pipe having improved efficiency, reliability, and speed of operation. A continuous, thin metal strip is corrugated, helically wound and seamed to form a durable yet bendable duct or pipe. The corrugation of the strip along its longitudinal axis is achieved by passing the thin metal strip through a plurality of synchronously driven (same RPM) corrugating strip roller die stands, each stand having progressively larger diameter rollers such that as a point on the metal strip passes from one corrugating strip roller stand to the next, the next stand rollers have progressively higher circumferential surface speed than the last, creating a pull on the strip material emerging from the preceeding roller stand, the pulling force at each stand preventing wrinkling or buckling of the strip as it passes through the corrugating operation. The corrugated strip is then helically wound into a bendable duct having a circular cross section by passing adjacent edges of the strip through novel, nonfouling front and rear strip lock tucking fingers which act to quickly but reliably interlock adjacent strip edges. The interlocked seam is then passed through and between compression rollers which have, peripherally disposed, a modified gear tooth pattern about their circumference forming a plurality of ridges and furrows along the seam. The bottom compression roller is ball-bearing mounted for free and unrestrictive rotation. All of the machine rollers, including the strip corrugating die rollers and the compression seam forming rollers are synchronously driven in rotation by a common drive motor through an endless drive chain. The continuously formed metal pipe may be cut to any desired length through the use of a cam-actuated moveable cut-off saw blade which severs the finished pipe perpendicular to the longitudinal axis of the pipe.

2 Claims, 17 Drawing Figures

MACHINE FOR THE MANUFACTURE OF HELICALLY WOUND METAL DUCT OR PIPE

BACKGROUND OF THE INVENTION

This invention relates generally to a machine for fabricating metal duct or pipe from a continuous, thin metal strip which is corrugated along its longitudinal axis, helically wound and interlocked along adjacent lateral edges to form a substantially circular, bendable metal duct. Helically wound metal duct has been widely utilized in recent years for the transport of hot and cold air in commercial and industrial applications. There have been many problems associated with mass production of the duct, some of which include the sensitivity of a thin metal strip to wrinkling or buckling during corrugation and in the positioning of the strip edges to expeditiously interlock adjacent lateral edges in a helically wound cut to insure a continuous, secure, interlocked seam. Many of the devices shown in the prior art for accomplishing the fabrication of such helically wound metal duct have proven to be quite slow in operation, unreliable and subject to stoppages which interrupt the continuous manufacture of the pipe. Additional problems have arisen in the cutting of the continuously formed duct at a desired length without slowing down the duct production.

The instant invention provides a machine for the manufacture of helically wound thin duct or pipe which greatly improves the efficiency of operation and the speed of manufacture and fabrication while increasing the reliability of the machine, the machine being subject to less production stoppages. These objectives are obtained by providing a duct forming machine in which all stages of fabrication are synchronized together from a common drive means to insure uninterrupted operation. Secondly, the corrugating roller die stands include progressively larger diameter rollers between stands which create a slight pull on the foil strip as it emerges from each succeeding roller die stand while being corrugated. The pulling force acts to prevent wrinkling or buckling of the thin metal strip as it passes through the corrugating roller die stands. The corrugating rollers further act to deform the lateral edges perpendicular to the plane of the strip to prepare them for seam interlock. The longitudinal corrugations in the strip are utilized with roller guides to direct the strip in a helical path to align adjacent lateral edges preparatory to forming the interlocked seam. The seam itself is formed by passing adjacent strip edges through a pair of tucking fingers which overlaps and interlock the edges together forming a seam which is then compressed with a ridge and furrow pattern.

The device includes a cam-actuated travelling, rotary saw that moves parallel to the longitudinal axis of the formed pipe at the same forward speed as the pipe during cutting. The saw blade is adjustable relative to the longitudinal axis of the formed duct to accomodate the cutting of duct of different diameters.

BRIEF DESCRIPTION OF THE INVENTION

A device and method for fabricating bendable metal duct or pipe from a continuous, thin, flat metal strip which is corrugated for strength along its longitudinal direction and helically wound, the strip being interlocked and seamed along adjacent lateral edges. The thin, ribbon-like metal strip (such as aluminum or stainless steel) is fed from an unreeler mounted next to one end of the machine, with the strip being fed initially through a plurality of initial strip flattening rollers which remove any large wrinkles, creases or buckled portions in the strip. Once emerging from the flattening rollers and a lubricating bath, the metal strip is passed through a plurality of corrugating rollers which corrugate the strip in the direction of its longitudinal axis to provide for increased rigidity. The actual corrugation is achieved using a plurality of roller die stands, with each stand having two substantially cylindrical corrugation rollers between which the metal strip passes with the roller surfaces deforming the strip while it moves through each pair of rollers at each roller stand. In one embodiment of the invention, there are eight corrugating roller die stands which are spaced apart and serially arranged to receive the continuous metal strip. At each roller die stand, the strip is corrugated and passed between a pair of equal diameter roller dies which are driven synchronously by a single motor (discussed in greater detail below). The movement of the roller dies at each roller die stand (top and bottom roller dies), in addition to corrugating the strip as it passes between, acts to feed the strip to the next roller stand. The diameters of the top and bottom roller dies, when proceeding from the first roller die stand, increase sequentially such that at the last corrugating roller die stand, the top and bottom rollers have a larger diameter than any of the proceeding roller die stands. Since the diameters increase at each succeeding roller die stand, the circumference of the roller dies, likewise increases. All of the roller dies, at each roller die stand, are synchronously driven by a chain drive connected to a common motor so that they all rotate at the same number of revolutions per minute (RPM). This means that the outer instantaneous tangential velocity on succeeding roller die surfaces will be slightly greater, which, as between adjacent roller die stands creates a pulling action on the strip as it emerges from the preceeding roller die preventing wrinkling or buckling of the strip. The pulling force on the strip, thus experienced at each roller die stand, prevents the strip from buckling or wrinkling because it is pulled from the previous roller dies rather than forced into the subsequent roller dies. The force exerted on the strip at each roller die stand insures a continuous movement of the strip through the corrugating stages without buckling or wrinkling which could cause interruption and stoppage of the strip. Also during the corrugating phase, the strip edges are folded perpendicular to the plane of the strip, the folded edges of adjacent helically disposed segments of the strip being ultimately joined and interlocked to form the pipe or duct.

After corrugation, the strip is fed to a plurality of circularly arranged, helical guide rollers which act in conjunction with the strip corrugations to guide the strip around a helical path to position and overlap adjacent lateral strip edges. While the edges are being overlapped, each strip edge passes through a tucking finger which interlock the edges together an additional 45°. One of the strip edge tucking fingers includes a metal deforming wall which protrudes above the strip support assembly angularly protruding in the path of one strip edge creating a metal bending channel that folds the lateral edge on one side of the strip an additional 45°. The special tucking finger includes a spaced vertical wall portion rising above the strip support assembly which is sized to receive the arcuate portion of the folded, lateral edge which as applicant has found, prevents bending or jamming of the edge while it is being deformed when passing through the tucker finger.

After the pipe leading edge and the continuously fed strip edge are overlapped and interlocked, the interlocked edges are received into a seam forming pair of compression rollers which include narrow gear tooth type surface which compresses the overlapped edges together forming ridges and furrows along the seam. The ridges and furrows provide additional longitudinal strength to insure a locked, air-tight seam along the formed pipe. The bottom gear toothed roller seam is ball-bearing mounted and is freely rotatable and moveable, with the upper roller being driven by the common motor. The free moving bottom seam forming band reduces fouling or jamming which might occur during the vital seam forming operation which likewise cooperates with the interlock operation of the tucking fingers to expedite passage of the strip through the tucking fingers.

The pipe is continuously formed along a supporting platform where it is cut into desired lengths. The pipe or duct is cut with a rotary, metal saw blade as the formed pipe moves continuously away from the seam forming area of the machine. In order to properly cut the pipe, the plane of the cutting blade must move perpendicular to the longitudinal axis of the pipe. Likewise, the angle of movement of the pipe from the seam-forming area will be related to the end equal to the helix angle which will be different for different diameter pipes. Thus the plane of the saw blade itself must be pivotable and adjustable to accomodate the formation of pipes of varying diameters. In the present invention the saw includes a specially designed cam for simultaneous movement of the saw blade with the pipe.

It is an object of this invention to provide an improved metal duct or pipe fabricating machine having increased efficiency and speed of operation.

It is another object of this invention to provide an improved strip metal duct rolling machine having increased reliability which significantly reduces or eliminates the strip buckling during the continuous duct forming operation.

And yet still another object of the invention is to provide a method and device for forming a thin metal or foil strip into corrugated, helical duct which includes a corrugating die roller assembly having progressively diametrically enlarged die rollers synchronously driven to create a pulling force on the strip between strip roller stands which prevents buckling or wrinkling of the foil strip during corrugation.

But still yet another object of this invention is to provide a duct fabricating machine which includes a variably sized, plurality of circularly disposed strip die rollers which guide the strip in a helical path utilizing the corrugations in the strip, the guide rollers being interchangeable and replaceable to provide for the fabrication of ducts having different diameters allowing for expeditious interchange of pipe diameter.

And yet still another object of this invention is to provide a metal strip duct forming machine with increased speed of operation which includes a non restrictive, free running, compression seam forming roller for crimping adjacent lateral edges during the pipe forming operation.

And yet still another object of this invention is to provide a cam actuated moveable and angularly adjustable pipe cutting saw which allows the continuous operation regardless of the formed pipe diameter.

In accordance with these and other objects which will be apparent hereinafter, the instant invention will now be described with particular reference to the accompanying drawings.

BRIEF DESCRIPTION OF THE DRAWINGS

FIG. 1A shows a cross-sectional view of the strip after longitudinal corrugation.

PREFERRED EMBODIMENT OF THE INVENTION

Figure 1:
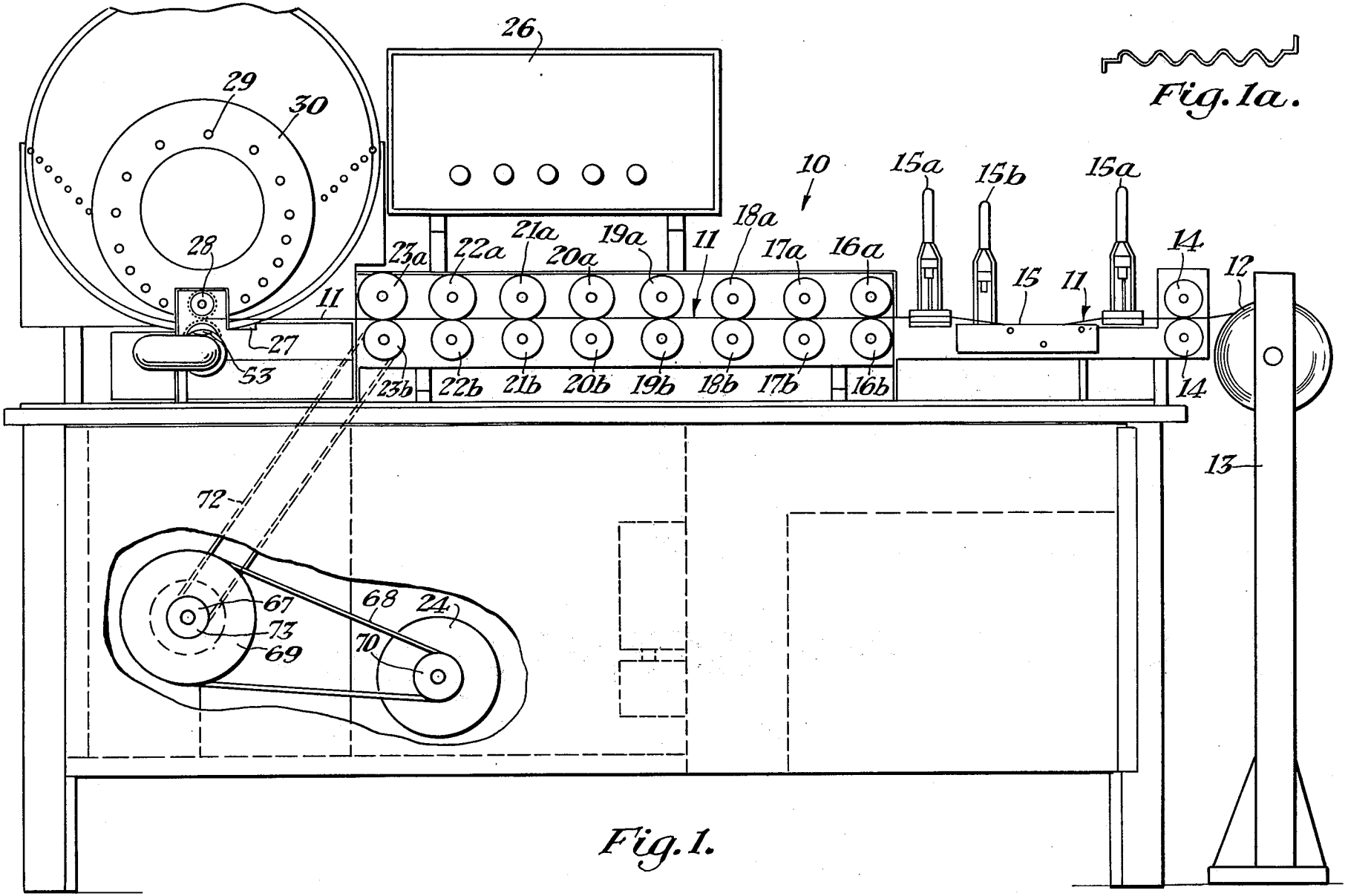
FIG. 1 shows a side elevational view of one embodiment of the duct fabricating machine utilized in the instant invention.

Referring now to the drawings, and specifically FIG. 1, the instant invention is shown at 10 receiving a thin strip 11 of metal from a conventional unreeler 12 mounted on a support 13 next to the machine. The metal strip 11 passes through a pair of flattening rollers 14 and into a lubricating bath 15 disposed between a plurality of strip guides **15*a* and squeeze 15*b*. After passing through the bath and the last strip guide 15*a***, the metal strip is ready to be corrugated longitudinally.

Strip 11 passed continuously through a plurality of corrugating roller die stands, each stand being comprised of a pair of roller dies **16*a* and 16*b* through 23*a* and 23*b*. When the strip emerges from the final roller die stand past roller dies 23*a* and 23*b* it has a cross-sectional, corrugated configuration as shown in FIG. 1A**.

The diameters of the pair of roller dies at each roller die stand increase progressively from roller dies 16*a* and 16*b* through roller dies 23*a* and 23*b*. The diameter of each roller die at each roller die stand (such as roller die 16*a* and 16*b*) is equal to each other. Thus, the diameter of roller die 16*a* is equal to the diameter of roller die 16*b*, the diameter of roller die 17*a* is equal to roller die 17*b* and so forth through roller dies 23*a* and 23*b*. However, the diameters or roller dies 16*a* and 16*b* are smaller than the diameters of roller die 17*a* and 17*b*, and so on. The separation however, between each of the paired roller dies at each stand remains constant throughout all roller die stands. The purpose of the increasing roller die diameters at succeeding roller die stands is to prevent wrinkling or buckling of the strip 11 as it passes from roller dies 16*a* and 16*b* down through roller dies 23*a* and 23*b*. This is achieved because all of the roller dies, 16*a*, 16*b* through 23*a* and 23*b* are synchronously driven through a chain drive system (shown in FIGS. 4A and 4B) by a common motor 24, connected to pulley 69 by belt 68 and pulley 70 connected to the motor drive shaft, resulting in the same RPMs at each roller die. Pulley 69 rotates shaft 67 driving sprocket 73 and chain 72 which drives a common shaft (FIG. 4B) described below. Since the diameters increase at each stand but the rotational velocity is the same for each roller die, the peripheral roller die surfaces at successive roller die stands has a progressively increasing tangential velocity which acts to pull the strip as it emerges from a preceeding roller die stand. This slight pull prevents wrinkling or buckling of the strip 11 as it emerges from a particular roller die stand.

Figure 3:
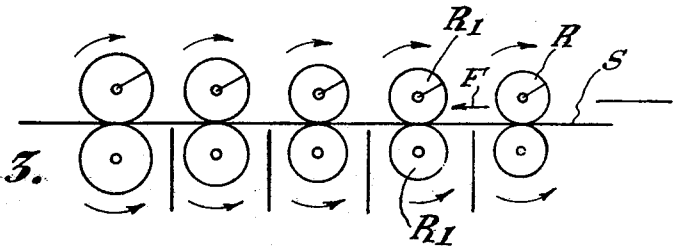
FIG. 3 shows a schematic drawing of the operating principle of the corrugating die rollers as utilized in the instant invention.

FIG. 3 shows schematically the operational principle of the enlarged progressive roller die diameters. The strip S passes through rollers R toward rollers R1 and experience a pulling force F because rollers R1 have a larger diameter than rollers R when all rollers are driven at a constant angular rate.

Referring back to FIG. 1, the control panel 26 for the machine is shown. Since the strip in the machine is self-loading, very little control is required during the continuous duct forming operation.

After corrugation, the strip 11 passes through the strip guide assembly 27 into the seam forming rollers 28 and thence to a plurality of helically disposed strip guide rollers 29 which guide the strip to form a circular diameter of the pipe in a helical path which allows the adjacent lateral edges of the pipe to be guided to an interlocked position adjacent the seam forming rollers 28. This operation is explained in greater detail below.

Figure 2:
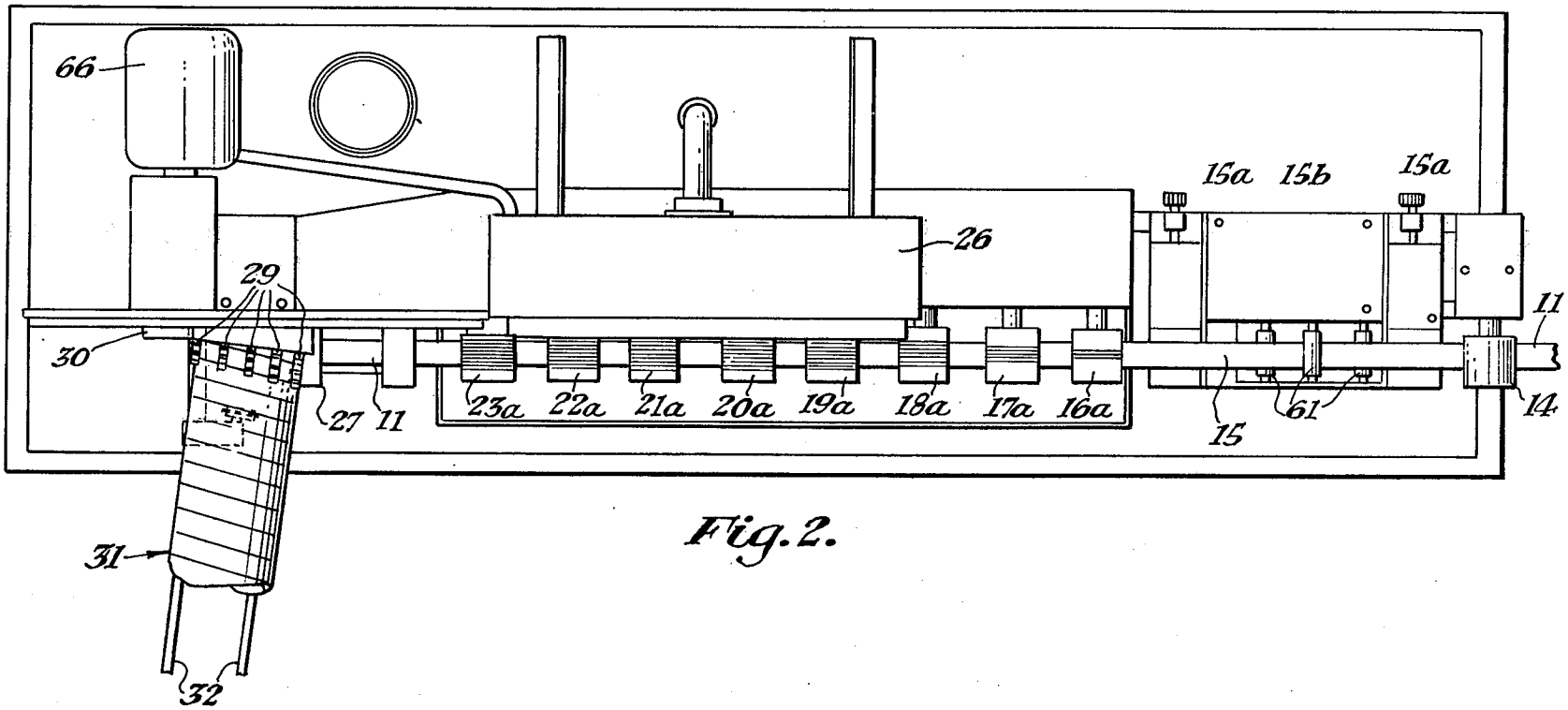
FIG. 2 shows a top plan view of the embodiment of the instant invention shown in FIG. 1.

Referring to FIG. 2, a continuously formed section of pipe 31 is shown resting on support rails 32 as it emerges from the helical guide roller 29 continuously. Each guide roller 29 has a grooved surface to correspond to the corrugations in the strip, with the grooves being disposed progressively outwardly toward the free end of the guide rollers 29 which act to direct the strip outwardly to form the helical yet circular path of the strip. The guide rollers are circularly arrayed on a rigid plate 30 (FIG. 1) so that the machine may fabricate pipe of different diameters by merely interchanging and replacing one array of guide rollers of a particular diameter for a different guide roller array different diameters.

Figure 4A:
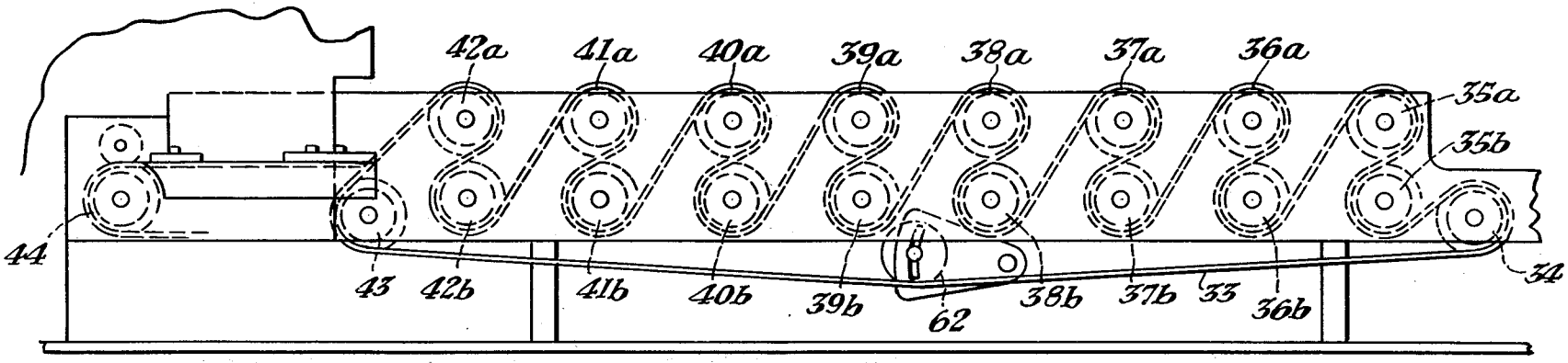
FIG. 4A shows a side elevational view illustrating the common drive chain for synchronously driving the die rollers as utilized in the instant invention.
Figure 4B:
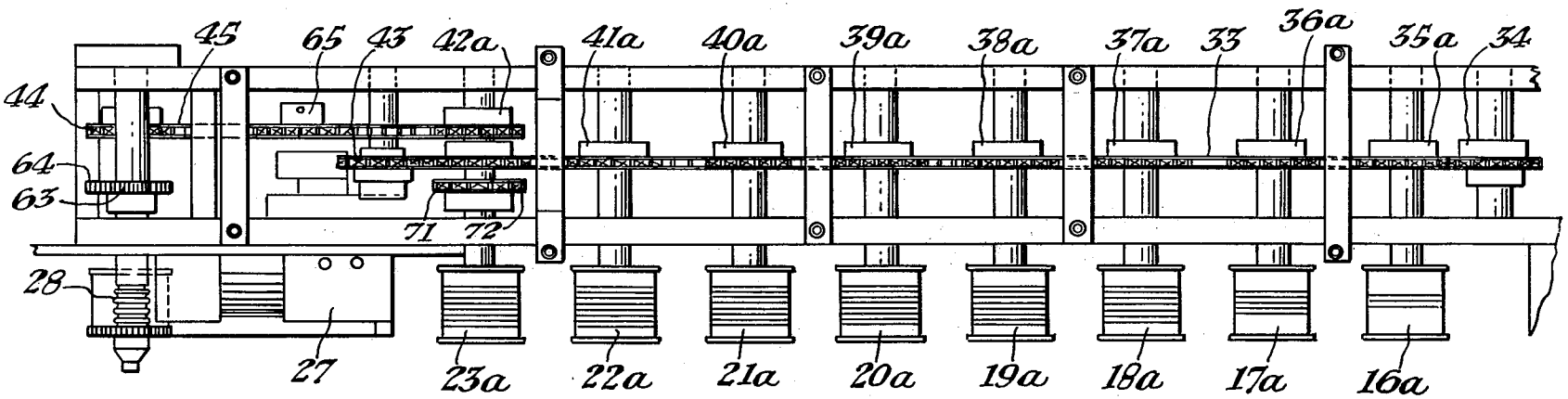
FIG. 4B is a top elevational view of the device shown in FIG. 4A.

Referring now to FIGS. 4*a* and 4*b*, the synchronous roller die drive system is shown which effects providing rotational movement to the various corrugation roller dies and the seam forming compression rollers from a common drive motor 24 (FIG. 1). A common chain 33 is connected to idler sprockets 34 and 43 and plurality of roller die drive sprockets 35*a* and 35*b* through 42*a* and 42*b*. The particular roller dies such as 16*a* and its associated bottom roller die 16*b* (not shown in FIGS. 4*a* and 4*b*) are driven and connected to sprockets 35*a* and 35*b* as are the remaining roller dies 17 through 23 connected to corresponding sprockets 36*a*, 36*b* through 42*a* and 42*b*. Thus, all of the corrugating roller dies are synchronously driven from chain 33 with the sprockets being sized for the roller die to provide the same revolutions per minute on each roller die. Another chain 45 (FIG. 4B) is connected to sprocket 44 which drives a compression seam forming roller 28 which is disposed adjacent the strip guide 27.

The synchronous drive system as shown provides for a smooth, continuous flow of operation as the strip continuously passes through the machine and is formed into the duct. Thus, even slight variations in rotational movement between adjacent operational stages is eliminated insuring that the strip will not buckle, wrinkle or be subjected to variable, unequal forces which may tend to stress, wrinkle or jam the strip, disrupting the continuous strip movement.

Figure 5:
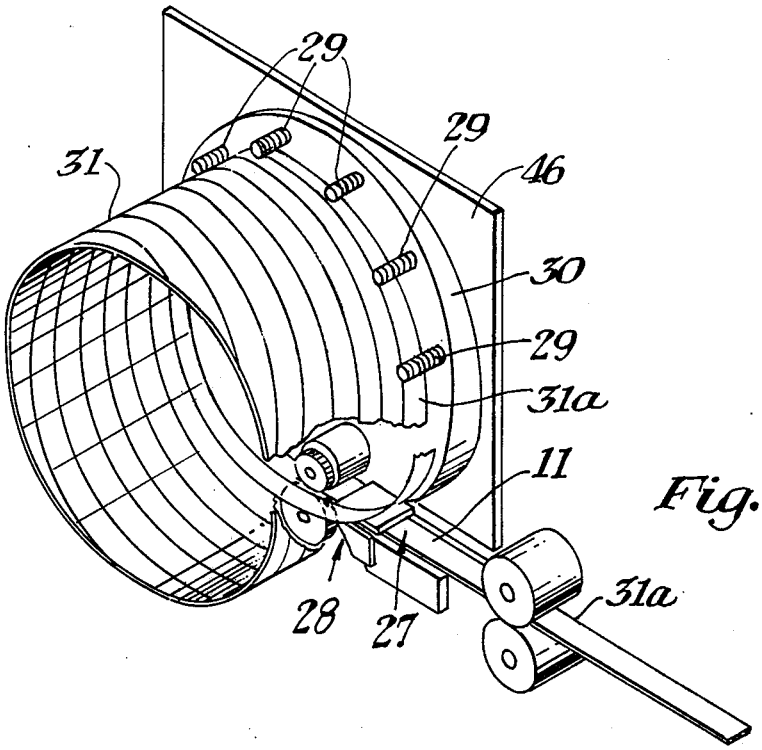
FIG. 5 shows a perspective view of the helical pipe forming guide rollers, with a portion of the pipe cut away exposing the seam forming compression rollers.

FIG. 5 shows the strip helical roller guides 29 connected to an adaptor plate 30 which is mounted on a fixed wall 46 of the device. The ring-shaped plate 30 is removeable and the machine supporting wall 46 can receive guide roller arrays of varying diameters which provides for forming pipes of different diameters. After the strip 11 emerges from the last roller die stand in the corrugation phase, it passes into the strip guide assembly 27 which stabilizes the strip preparatory to being received into the tucking fingers which form an interlocked seam that is compressed and ridged by rollers 28. The helical roller guides 29 include a plurality of grooves circumferentially disposed which receive the corrugations in the strip 11 to guide the strip circularly but helically around the guide rollers so that the strip is positioned progressively farther away from the mounting plate 30 in accordance with a helical angle determined by the diameter of the formed pipe. The grooved surface portions on the guide rollers 29 are spaced progressively further from the plate 30 as one proceeds around the array moving the trailing edge of the formed pipe to a portion adjacent the lateral edge of the strip 11, with both edges passing through the tucking fingers and the seam-forming compression rollers 28.

Figure 6:
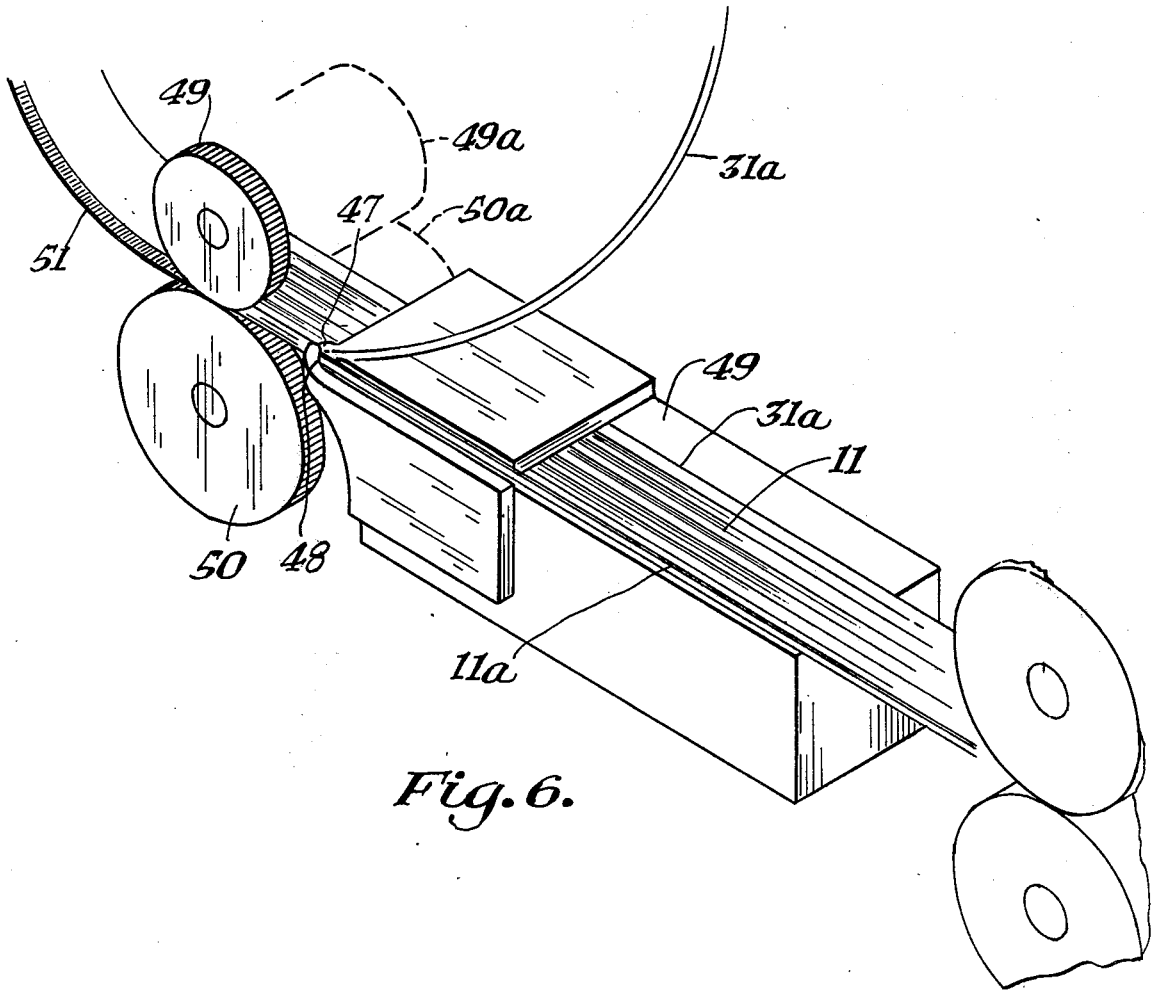
FIG. 6 shows a perspective view of the strip guide assembly, tucking fingers, and the seam forming compression rollers as utilized in the instant invention.

FIG. 6 shows the front tucking finger 48 and the rear tucking finger 47 integrally formed and connected to the strip guide assembly blocks shown generally as 27 (FIG. 5). The seam forming compression rollers include roller portions 49 and 50 which have a gear tooth type pattern disposed about their circumference which intermesh to provide a ridge and furrow pattern along the compressed, interlocked edges.

FIG. 6 shows the strip 11 as it emerges from the last corrugating roller die stand, the strip having one lateral edge 11*a* which is perpendicular to the plane of the strip 11 disposed vertically upward and lateral edge 31*a* disposed vertically downward also perpendicular to the plane of the strip 11. Edge 31*a* becomes the trailing edge of the formed pipe.

Figure 7A:
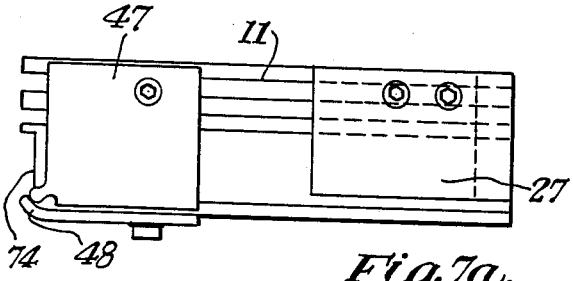
FIG. 7A is a top plan view of the strip guide assembly and tucking fingers.
Figure 7B:
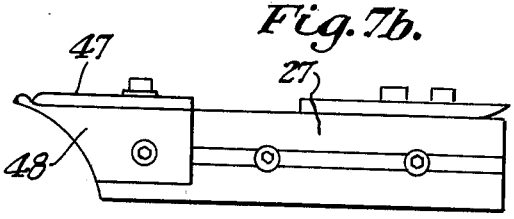
FIG. 7B is a side elevational view of the strip guide assembly and tucking fingers.
Figure 9:
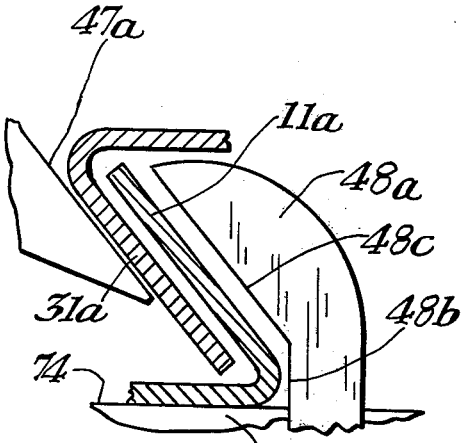
FIG. 9 is a front elevational view partially in cross-section showing the interlocked edges in the tucking fingers.

The front tucking finger 48 acts to fold and bend the strip lateral edge 11*a* at a 45° angle down towards the strip body itself while tucking finger 47 folds the trailing edge 31*a* of the formed pipe which is likewise perpendicular, upwardly such that the adjacent lateral edges 11*a* and 31*a* are interlocked as shown in FIG. 9 (spacing exaggerated for clarity). FIGS. 7*a* and 7*b* show the strip guide assembly 27 which stabilizes the strip for passage into the tucking fingers 47 and 48. The strip guide is essentially a flat plate disposed over a strip mounting assembly with a grooved inner surface having the same corrugated pattern as the strip itself and acts to keep the strip flat and prevent buckling or wrinkling.

Figure 8:
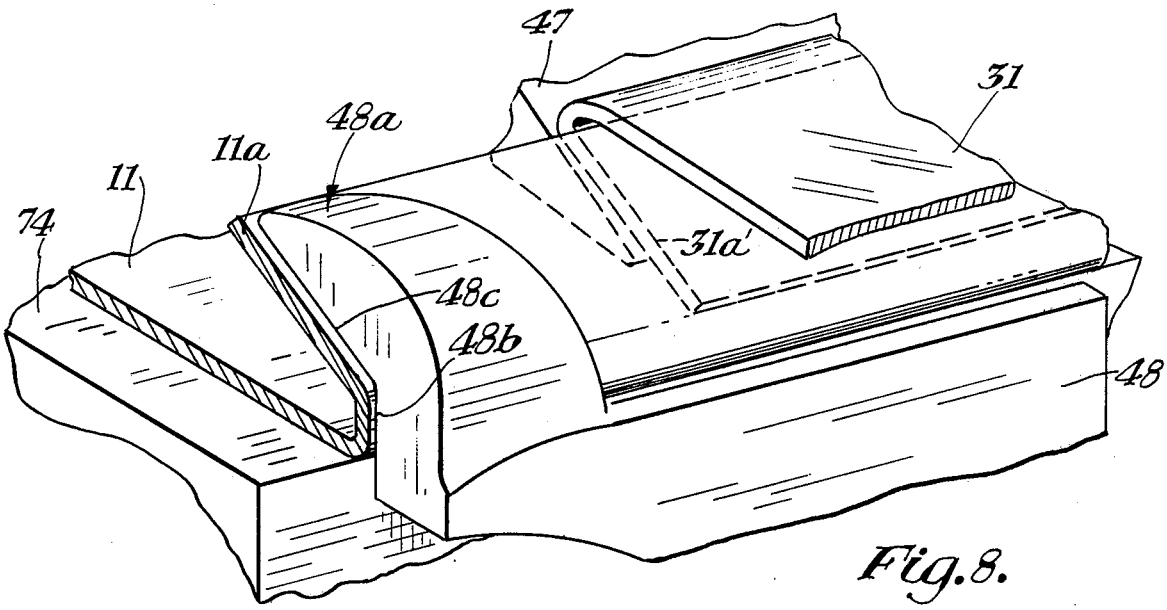
FIG. 8 is a close up perspective, cut-away view of adjacent strip edges being overlapped and interlocked by the front and rear tucking fingers.

FIG. 8 shows the tucking fingers 47 and 48 disposed very close to each other which act to deform and interlock the trailing edge 31*a* of the formed pipe with the lateral edge 11*a* of strip 11. The trailing edge of the pipe 31 and the perpendicular edge 31*a* progress from the helical guide rollers into the rear tucking finger 47 which has an angular wall 47*a* (FIG. 9) at a 45° angle, and almost simultaneously, strip lateral edge 11*a* is bent by contacting surface 48*c* of tucking finger 48. Vertical wall 48*b* provides a space above the strip mount surface 74. The vertical space 48*b* is an important aspect of the invention in that Applicant has found that by providing a tucking surface raised above the strip mounting surface 74, the strip 11 does not jam during the interlock phase. It should be noted that the pipe lateral edge 31*a* is moving downwardly and subjected to a centrifugal force which acts to push the pipe section outwardly against the recessed walls 47*a* of the tucking finger 47. The strip edge 11*a* are forced through the tucker finger 48.

Figure 10:
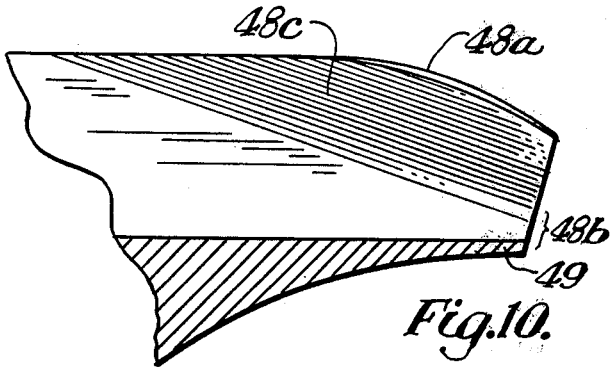
FIG. 10 is a cut-away side-elevational view of the inside wall surface of one of the tucking fingers.

FIG. 9 shows the strip edge 11*a* and the pipe leading edge 31*a* substantially overlapped and interlocked, preparatory to the final seam compression stage. The vertical wall 48*b* spaced to begin above the strip support 74, deforms the strip lateral edge 11*a* to a substantial 45° position. The inner wall 48*c* (as shown in FIG. 10) of the tucking finger gradually tapers to the 45° position as shown in FIG. 9 at the trailing edge of the tucking finger. FIG. 10 also shows the raised vertical portion 48*b* which is the bottom-most vertical edge joining the angular wall 48*c* to provide the 45° bend in the strip edge 11*a*.

The strip as now overlapped between the lateral edge 11*a* of the moving strip and the trailing edge 31*a* of the formed pipe (FIG. 9) are now ready for the seam forming compression rollers 49 and 50 as shown in FIG. 6. The top and bottom rollers 49*a* and 50*a* are provided which each have a surface corrugated pattern formed in the corrugated pattern of the strip itself. Seam compression rollers 49 and 50 are included which have a gear tooth type pattern disposed around their peripheral edges and which are approximately the width of the pipe seam such that when the interlocked walls of the strip edge 11*a* and the pipe trailing edge 31*a* are received therebetween, a ridge and furrow pattern is formed along the seam when the overlapped edges are pressed together. The upper roller 49*a* and the upper seam forming roller 49 are motor-driven as in the lower roller 50*a*. However, the lower seam-forming compression roller 50 (FIG. 11) is freely rotatable and is ball-bearing mounted to move freely in conjunction with the upper seam forming compression roller 49 which is driven. Applicant has found that this improves and expedites the seam forming operation and reduces buckling or jamming during the entire interlock seam forming operation.

Figure 11:
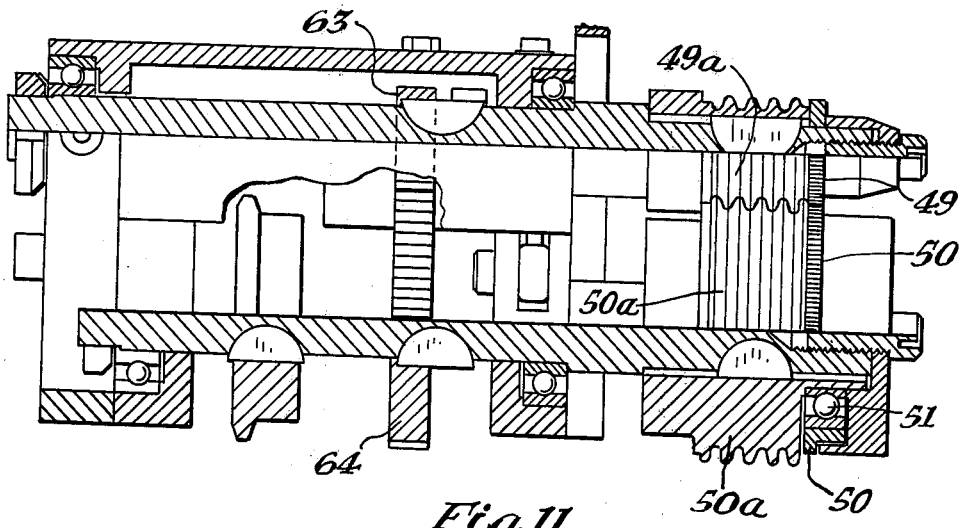
FIG. 11 is a side elevational view partially in cross-section of a seam forming compression roller as utilized in the instant invention.

FIG. 11 shows the corrugated strip guide roller 49*a* which is integrally connected with the seam forming compression roller 49 so that they move together. Roller 50*a* is likewise driven synchronously with roller 49*a*. The compression seam forming roller 50, however, includes ball-bearings 51 which allows it to rotate freely, independent of the driven movement of roller 50*a*. The seam between adjacent strips to form the continuous pipe is thus compressed and formed between compression rollers 49 and 50 which imparts ridges and furrows along the strip seam insuring a tight, extremely strong seam helically disposed about the continuously formed duct. The rollers 49*a* and 50*a* and compression ring 49 are synchronously driven by gears 63 and 64 having the same pitch diameter as rollers 49 and 50 connected to the common motor system.

Figure 13:
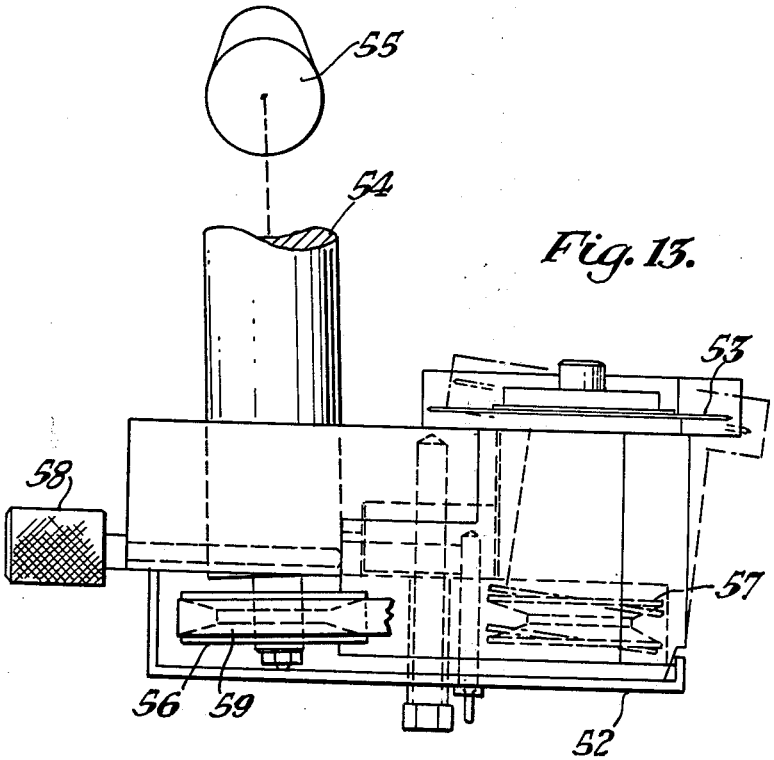
FIG. 13 is a top plan view showing the saw drive and adjustment mechanism with a cam representation as utilized in the instant invention.
Figure 12A:
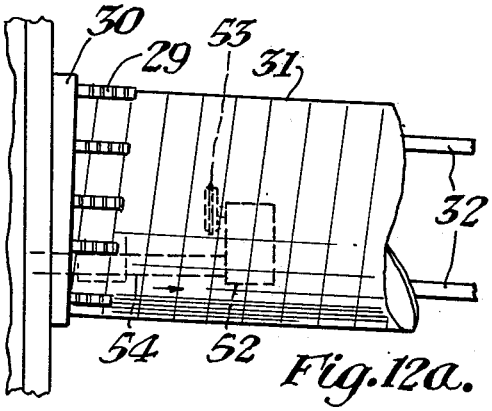
FIGS 12A and 12B are top elevational views partially cut-away showing the pipe forming helical guide rollers for different diameter pipe and schematic representations of the adjustable saw utilized to cut pipe while it is continuously formed.
Figure 12B:
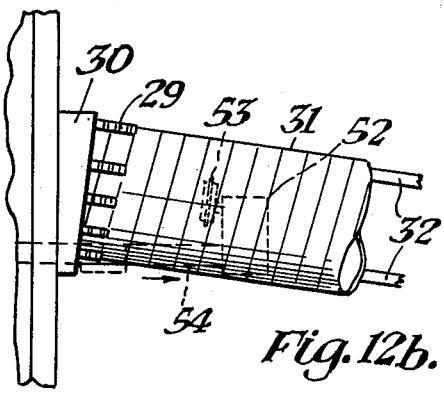

Once the pipe is formed, it rotates helically outward from the guide rollers 29 (FIGS. 12*a* and 12*b* which show pipes of different diameters being formed). It is now ready to be cut into particular lengths. In order to cut the continuously formed pipe in a plane perpendicular to the longitudinal axis, a saw mounted on housing 52, and saw blade 53 which may be a rotary cutting blade must move with the pipe. Likewise, in order to cut pipes of different diameters which are formed at different helical angles in the machine, the blade 53 must be able to be adjusted angularly to accommodate varying diameter pipes. FIG. 13 shows a saw supporting arm 54 which is connected to the common motor drive system through gears and pulleys having a pulley 56 connected by belt 59 to second pulley 57 connected to a rotary saw blade 53 mounted within housing 52. The cam drive 55 is located within the machine and synchronized with the pipe movement with a control switch for cutting. A switch actuates the drive cam 55 to move the mounting shaft 54 and saw assembly in the direction of the arrow at a speed comparable to the speed and movement of the pipe as it is being formed. This insures that the saw blade 53 will move synchronously with the continually formed pipe surface while it is cutting. The blade angle or the plane of the cutting blade is angularly moveable and adjustable which allows the pulley and blade driving mechanism to be moved and angularly positioned relative to the emergency pipe longitudinal axis to accomodate cutting pipes of varying diameters and therefore, varying emerging helical angles. The blade 53 is thus moveable to insure that the pipe is cut perpendicular to the longitudinal axis of the pipe. Through the camming mechanism 55, the blade disposed below the pipe moves upwardly to contact the material as the blade moves longitudinally in the direction of the material during cutting such that the continuous forming of the pipe is not interrupted. When it is necessary to change the diameter of the pipe being formed, which may be done by changing the helical guide roller plates 30 (FIGS. 12*a* and 12*b*), the saw blade angle is then manually adjusted. Knob 58 tensions belts 59.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. An apparatus for manufacturing bendable duct from a ductile strip wherein:

a plurality of strip guide rollers mounted upon a removeable plate disposed in a circular array define the diameter of the formed duct, and whereby duct of different diameters can be formed by interchanging said removeable plates with strip guide rollers having a grooved surface for receiving corrugations in the strip, the grooves in each roller being spaced relative to adjacent roller to guide said strip in a helical path and whereby all stages of fabrication are synchronously driven together from a common drive means, the improvement comprising a plurality of different increasing adjacent diameter pairs of strip corrugating roller dies mounted adjacent each other and being disposed in an array which receives a ductile strip for corrugating said strip longitudinally, said pairs of corrugating roller dies being synchronously drive at a constant angular rotational rate; and means for overlapping and interlocking leading edge of said strip with the trailing edge of a formed duct including a strip edge tucking finger and a trailing edge tucking finger disposed adjacent each other, said strip edge tucking finger having a deforming wall disposed angularly with respect to said first edge to deform said strip edge at an angle relative to the strip edge plane and a vertical wall disposed below said deforming wall to provide a space between said deforming wall and the strip mounting surface, said overlapped and interlocked edges thereafter being compressed into a tight duct seam.

2. An apparatus, as in claim 1, wherein:

each of said pair of different diameter strip corrugating roller dies is disposed in an array with the smallest diameter paired roller dies receiving said strip first, and with the diameter of the pairs of rollers increasing in each succeeding pair of corrugating rollers whereby a puller force is experienced on said strip as it emerges from the preceeding roller die pair.

* * * * *

UNITED STATES PATENT OFFICE

CERTIFICATE OF CORRECTION

PATENT NO. : 4,058,996

DATED : November 22, 1977

INVENTOR(S) : Claude W. Schaefer

It is certified that error appears in the above-identified patent and that said Letters Patent are hereby corrected as shown below:

Under Inventors, delete --Schaeffer-- and insert therefore "Schaefer".

Signed and Sealed this

*Twenty-eighth* Day of *October 1980*

[SEAL]

*Attest:*

SIDNEY A. DIAMOND

*Attesting Officer*

*Commissioner of Patents and Trademarks*